US008011878B2

(12) United States Patent
Hwang et al.

(10) Patent No.: US 8,011,878 B2
(45) Date of Patent: Sep. 6, 2011

(54) CENTRIFUGAL FAN AND ELECTRONIC DEVICE USING SAME

(75) Inventors: Ching-Bai Hwang, Taipei Hsien (TW); Zhi-Hui Zhao, Shenzhen (CN); Ran Lin, Shenzhen (CN)

(73) Assignees: Furui Precise Component (Kunshan) Co., Ltd., KunShan, Jiangsu Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 520 days.

(21) Appl. No.: 12/329,610

(22) Filed: Dec. 7, 2008

(65) Prior Publication Data

US 2010/0142146 A1 Jun. 10, 2010

(51) Int. Cl.
*H04D 17/08* (2006.01)

(52) U.S. Cl. ..... 415/102; 415/204; 415/206

(58) Field of Classification Search ..... 415/102, 415/204, 206, 203

See application file for complete search history.

(56) References Cited

U.S. PATENT DOCUMENTS

| | | | | |
|---|---|---|---|---|
| 5,188,508 | A * | 2/1993 | Scott et al. | 415/206 |
| 6,634,855 | B1 * | 10/2003 | Rollo | 415/206 |
| 2007/0248459 | A1 * | 10/2007 | Tseng et al. | 415/206 |
| 2008/0310957 | A1 * | 12/2008 | Lyons | 415/204 |
| 2010/0096212 | A1 * | 4/2010 | Smiley et al. | 180/321 |

* cited by examiner

*Primary Examiner* — Gary F. Paumen

(74) *Attorney, Agent, or Firm* — Altis Law Group, Inc.

(57) ABSTRACT

A centrifugal fan includes a housing and an impeller. The housing includes a base plate, a side plate extending upwardly from a periphery of the base plate and a concave portion depressed downwardly from a central portion of the base plate. The concave portion includes a bottom wall spaced from the base plate and a side wall interconnects with the base plate. An air inlet is defined in the bottom wall. The impeller includes a hub and a plurality of blades extending radially from the hub. The impeller is rotatably arranged on the bottom wall of the concave portion. A bottom face of each of the blades extends into the concave portion.

12 Claims, 5 Drawing Sheets

CENTRIFUGAL FAN AND ELECTRONIC DEVICE USING SAME

BACKGROUND

1. Technical Field

The disclosure generally relates to centrifugal fans and, more particularly, to an electronic device incorporating a centrifugal fan for dissipating heat generated therefrom.

2. Description of Related Art

With the fast development of the electronics industry, electronic components, such as central processing units (CPUs), or video graphics array (VGA) chips, are being made with ever faster operating speeds. During operation of the electronic components, a large amount of heat is generated. Greater emphasis is now being laid on increasing the efficiency and effectiveness of heat dissipation devices so as to keep operational temperature of the electronic components within a suitable range.

Conventionally, a fan is used in combination with a heat dissipation device to produce an airflow in order to remove heat from the electronic components. Since most of electronic systems that contain electronic components therein, such as a laptop computer or a desktop computer, do not have enough space therein, a centrifugal fan which requires only a small space for installation is generally used. The centrifugal fan has at least an air inlet and an air outlet oriented perpendicularly to the at least an air inlet. In use, the centrifugal fan generates an airflow from the at least an air inlet towards the electronic component via the air outlet, thus cooling the electronic component continuously.

The diameter of the at least an air inlet is smaller than the diameter of an impeller of the centrifugal fan. For avoiding friction between the impeller and a housing of the centrifugal fan, an axial clearance must be defined between the housing and the impeller, which conflicts with the requirement that the centrifugal fan can only occupy a small space in the electronic system. Additionally, due to the presence of the clearance, portion of the airflow flows back to the at least an air inlet via the clearance directly, thus to cause air turbulence at the least an air inlet and decrease air pressure in the centrifugal fan.

Therefore, there is a need for a centrifugal fan, which can eliminate the limitations described.

DETAILED DESCRIPTION

Figure 1:
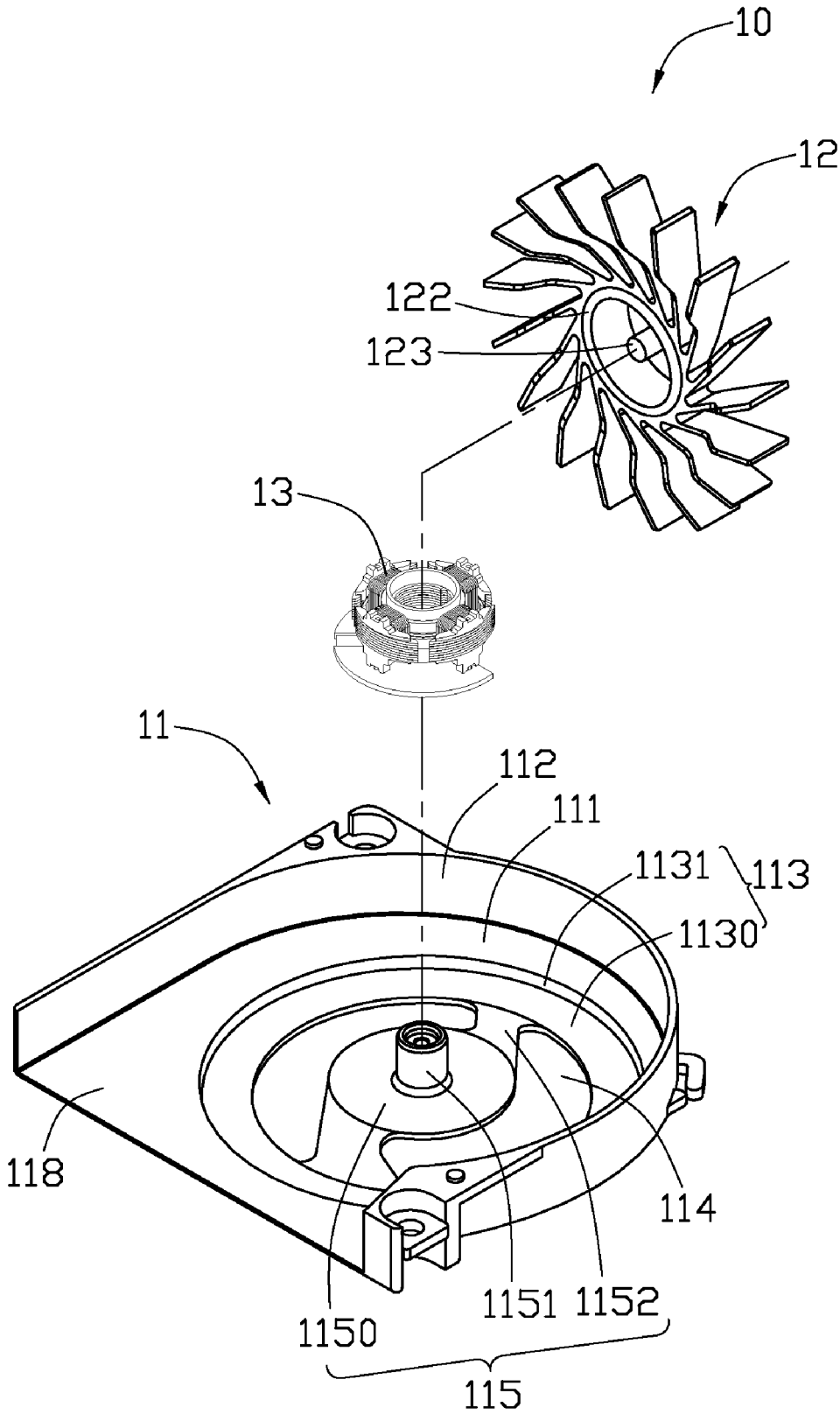
FIG. 1 is an isometric, exploded view of a centrifugal fan in accordance with an exemplary embodiment.

Reference will now be made to the drawing figures to describe the embodiment in detail.

Figure 2:
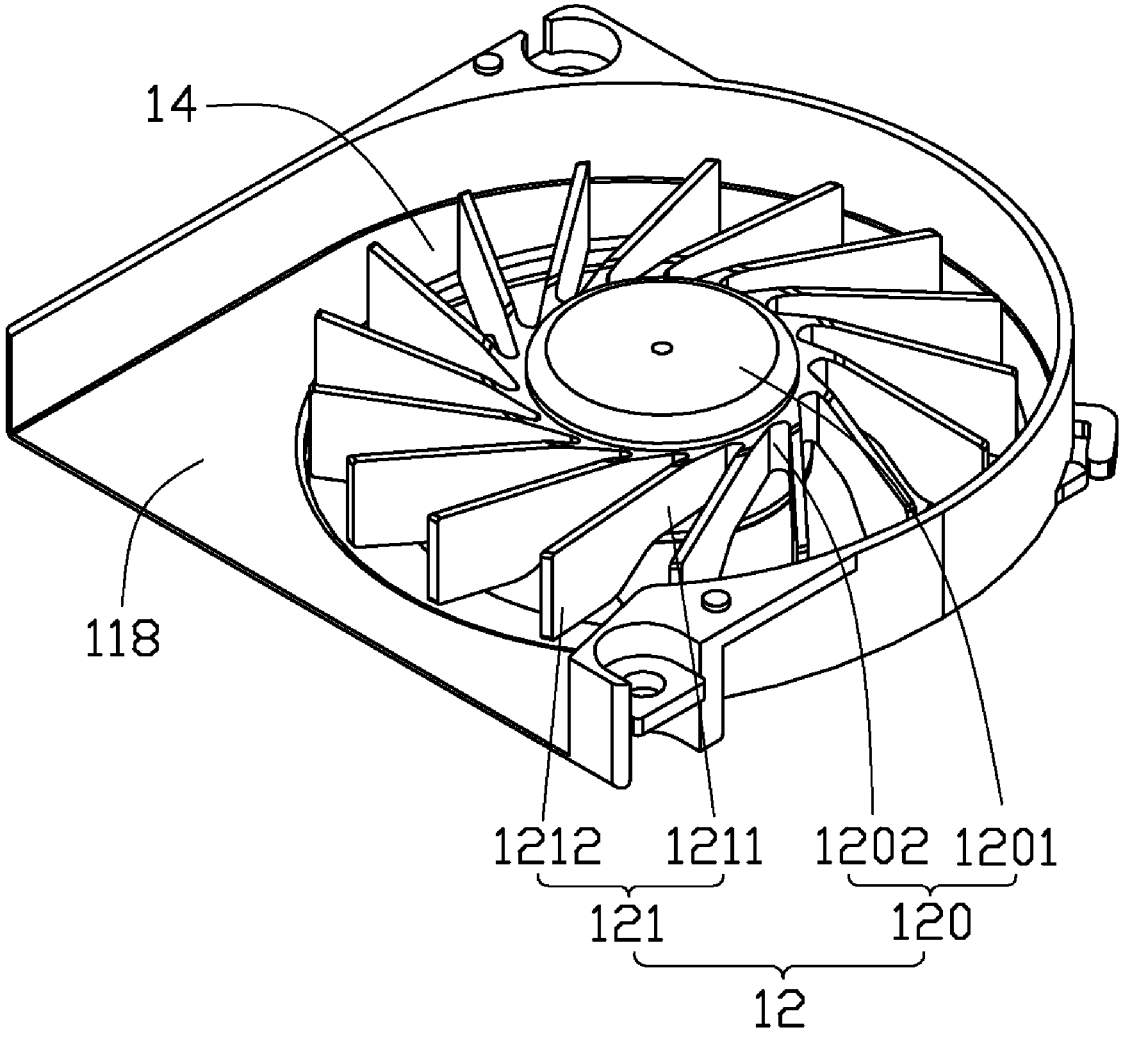
FIG. 2 is an assembled view of the centrifugal fan of FIG. 1.

Referring to FIGS. 1 and 2, an isometric, exploded view of a centrifugal fan 10 in accordance with a first embodiment is illustrated. The centrifugal fan 10 includes a housing 11, a stator 13 received in the housing 11 and an impeller 12 driven by the stator 13 to be rotatable with respect to the stator 13 in the housing 11.

The housing 11 includes a base plate 111, a volute side plate 112 extending upwardly and perpendicularly from an outer periphery of the base plate 111. The base plate 111 and the side plate 112 are integrally formed by injection molding process as a single piece. The base plate 111 and the side plate 112 cooperatively define a space for receiving the impeller 12 therein. The side plate 112 surrounds the impeller 12. A volute air channel 14 is defined between the side plate 112 and an outer periphery of the impeller 12.

Figure 3:
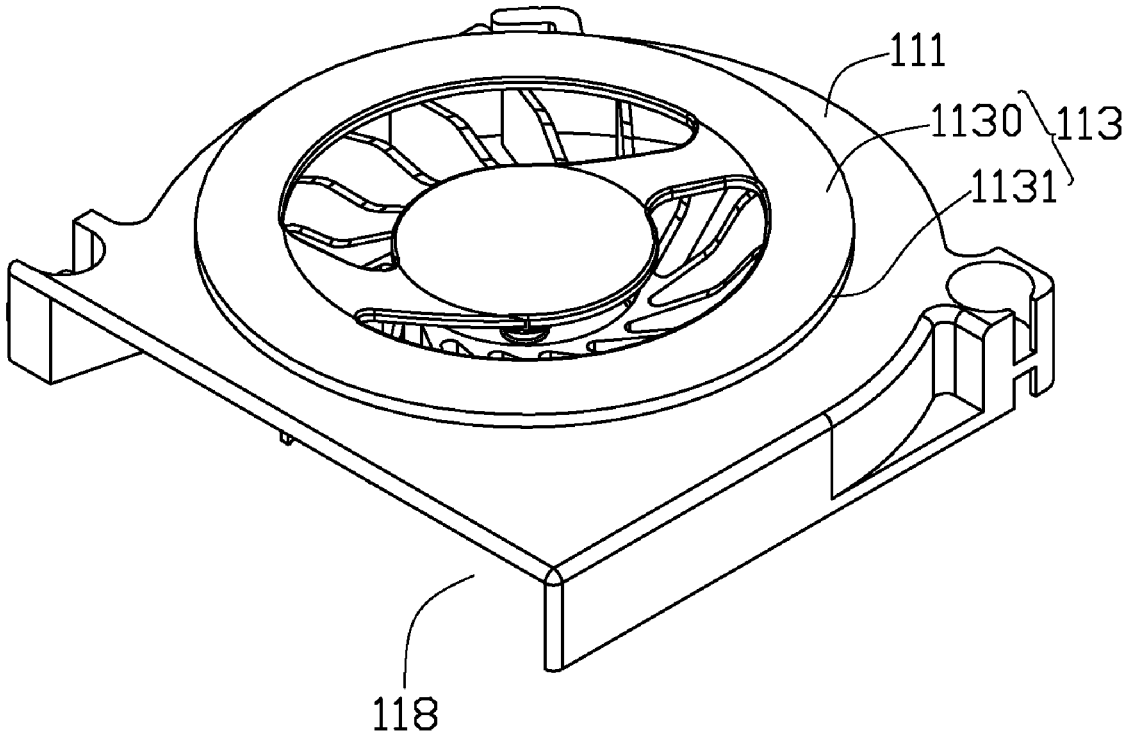
FIG. 3 is an inverted view of the centrifugal fan of FIG. 2.

Referring to FIG. 3, a central portion of the bottom plate 111 depresses downwardly to form a columned concave portion 113 thereat. The concave portion 113 includes an annular bottom wall 1130 parallel to the base plate 111 of the housing 11 and a side wall 1131 extending downwardly and perpendicularly from the base plate 111 for interconnecting an outer periphery of the bottom wall 1130 and an inner periphery of the base plate 111. A height difference between the bottom wall 1130 and the base plate 111, i.e., a depth of the concave portion 113 is about 0.5 mm~2.0 mm. The bottom wall 1130 of the concave portion 113 defines a through hole therein for functioning as an air inlet 114 of the centrifugal fan 10. A base 115 is received in the air inlet 114. The base 115 includes a circular supporting plate 1150 positioned on a central portion of the air inlet 114, a central tub 1151 extending upwardly and perpendicularly from the supporting plate 1150 and a plurality of ribs 1152 extending radially from an outer periphery of the supporting plate 1150 to an inner periphery of the bottom wall 1130. The supporting plate 1150 and the base plate 111 are coplanar. The ribs 1152 extend slantways from the outer periphery of the supporting plate 1150 to the inner periphery of the bottom wall 1130.

Figure 4:
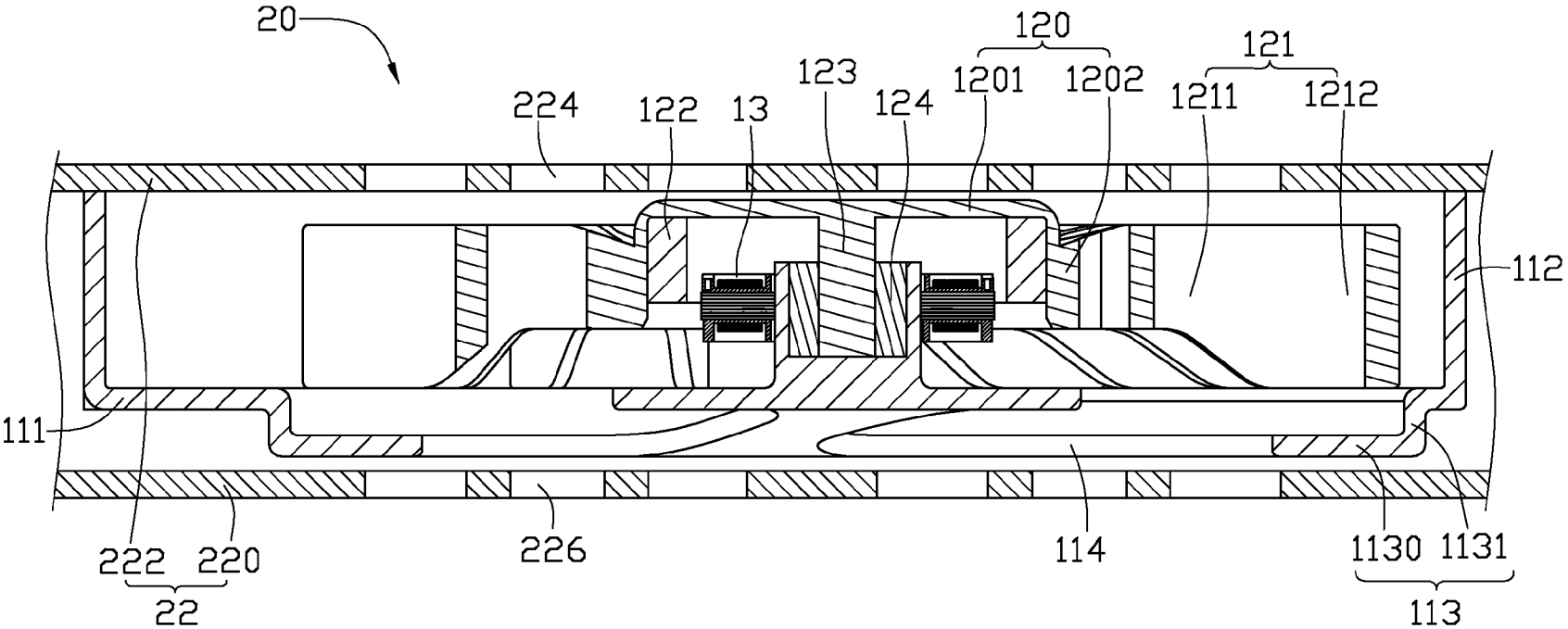
FIG. 4 is a cross-sectional view of the centrifugal fan of FIG. 1 assembled to an electronic device for dissipating heat of the electronic device.

Referring to FIG. 4, the impeller 12 is located above the base 115 and received in the concave portion 113 of the housing 11. The impeller 12 includes a hub 120 and a plurality of blades 121 extending radially and outwardly from the hub 120. The hub 120 includes a circular top wall 1201, an annular wall 1202 extending downwardly from an outer periphery of the top wall 1201, a magnet 122 attached to an inner surface of the annular wall 1202, and a shaft 123 extending downwardly from a central portion of the top wall 1201. When assembled, the stator 13 is mounted around the central tube 1151, and the shaft 123 is rotatably received in the central tub 1151 through a bearing 124 for mounting the impeller 12 to the central tube 1151.

Each of the blades 121 is planar-shaped and extends outwardly from the annular wall 1202 of the hub 120 along a clockwise direction, as viewed from FIG. 2. Each of the blades 121 includes a first blade portion 1211 fixed to the annular wall 1202 of the hub 120 and a second blade portion 1212 extending outwardly from a distal end of the first blade portion 1211.

Each of the first blade portions 1211 has a top face and an opposite bottom face. The top face of the first blade portion 1211 extends horizontally along an extension direction of the first blade portion 1211, and the bottom face of the first blade portion 1211 extends downwardly along the extension direction of the first blade portion 1211. Thus, a longitudinal height of the first blade portion 1211 gradually increasing as the first blade portion 1211 extends outwardly from the hub 120 towards the second blade portion 1212. The bottom face of the first blade portion 1211 at the distal end is lower than the bottom face of the first blade portion 1211 at an inner end fixed to the annular wall 1202. An outer diameter of the first blade portion 1211 substantially equals to the diameter of the air inlet 114. Each of the second blade portions 1212 has a top face and an opposite bottom face. The top face and the bottom face of the second blade portion 1212 are horizontally and parallel to the bottom wall 1130. The longitudinal height of each of the second blade portions 1212 is constant. The top face of the second blade portion 1212 is coplanar with the top face of the first blade portion 1211, and the bottom face of the first blade portion 1211 at the inner end is higher than the bottom face of the second blade portion 1212. The longitudinal height of second blade portions 1212 equals to a maximal longitudinal height of the first blade portions 1211. An inner diameter of the second blade portions 1212 is substantially the same as that the diameter of the air inlet 114.

For avoiding contact and friction between the impeller 12 and the housing 11 as the impeller 12 rotates, a radial clearance is defined between distal ends of the second blade portions 1212 and the side wall 1131 of the concave portion 113, and an axial clearance is defined between the bottom faces of the second blade portions 1212 and the bottom wall 1130 of the concave portion 113. In the present embodiment, an outer diameter of the second blade portions 1212 is slightly smaller than the diameter of the concave portion 113, and the radial clearance of is about 0.05 mm. The bottom faces of the second blade portions 1212 are lower than the base plate 111 of the housing 11, thus a size of the blade 121 at the second blade portion 1212 is increased. A windward lateral surface of each of the blades 121 is thus increased for increasing air pressure and amount of airflow during operation of the centrifugal fan 10.

Alternatively, the supporting plate 1150 of the base 115 and the bottom wall 1130 of the concave portion 113 can be coplanar, and thus the supporting plate 1150 is lower than the base plate 111 of the housing 11. Accordingly, the ribs 1150 extend horizontally form the outer periphery of the supporting plate 1150 to the inner periphery of the bottom wall 1130. The longitudinal height of the first blade portion 1511 of each of the blades 121 above the base 115 can be increased to equal the longitudinal height of the second blade portion 1212. That is, the windward lateral surface of each of the blades 121 is further increased for increasing the air pressure and amount of airflow during operation of the centrifugal fan 10.

Referring to FIG. 4, a schematic view of an electronic device 20 incorporating with the centrifugal fan 10 is illustrated. The electronic device 20 is a portable electronic device such as laptop computer, etc. The electronic device 20 includes a shell 22 having a bottom cover 220 and a top cover 222 opposite to the bottom cover 220. The bottom cover 220 defines a first through hole 226 and the top cover 222 defines a second through hole 224, both of which correspond to the air inlet 114 of the bottom wall 1130 of the centrifugal fan 10. The centrifugal fan 10 is between the bottom cover 220 and the top cover 222 with a top end of the side plate 112 contacted with a bottom surface of the top cover 222. The bottom wall 1130 of the concave portion 113 of the housing 11 faces the bottom cover 220, and spaces a distance from the bottom cover 220. The first through hole 224 of the top cover 222 functions as another air inlet of the centrifugal fan 10.

During operation, high-pressure airflow generated by the rotation of the blades 121 accumulates in the air channel 14 and flows towards the air outlet 118 along the side plate 112 of the housing 11. Due to the concave portion 113, a longitudinal height of the space above the concave portion 113 for receiving the blades 121 is increased; thus, the longitudinal height of the second blade portion 1212 of each of the blades 121 can be increased for increasing air pressure and amount of airflow during operation of the centrifugal fan 10. Moreover, since the second blade portions 1212 are lower than the base plate 111 of the housing 11, the axial clearance and the air channel 14 are staggered up and down, refluxed airflow around an outer periphery of the blades 121 towards the air inlet 114 is blocked by the distal ends of the second blade portions 1212. As a result, air turbulence at the air inlet 114 caused by the refluxed airflow is reduced so that exterior air enters into the centrifugal fan 10 more smoothly, noise generated by the air turbulence is reduced and air pressure and amount of airflow in the centrifugal fan 10 is further increased.

Figure 5:
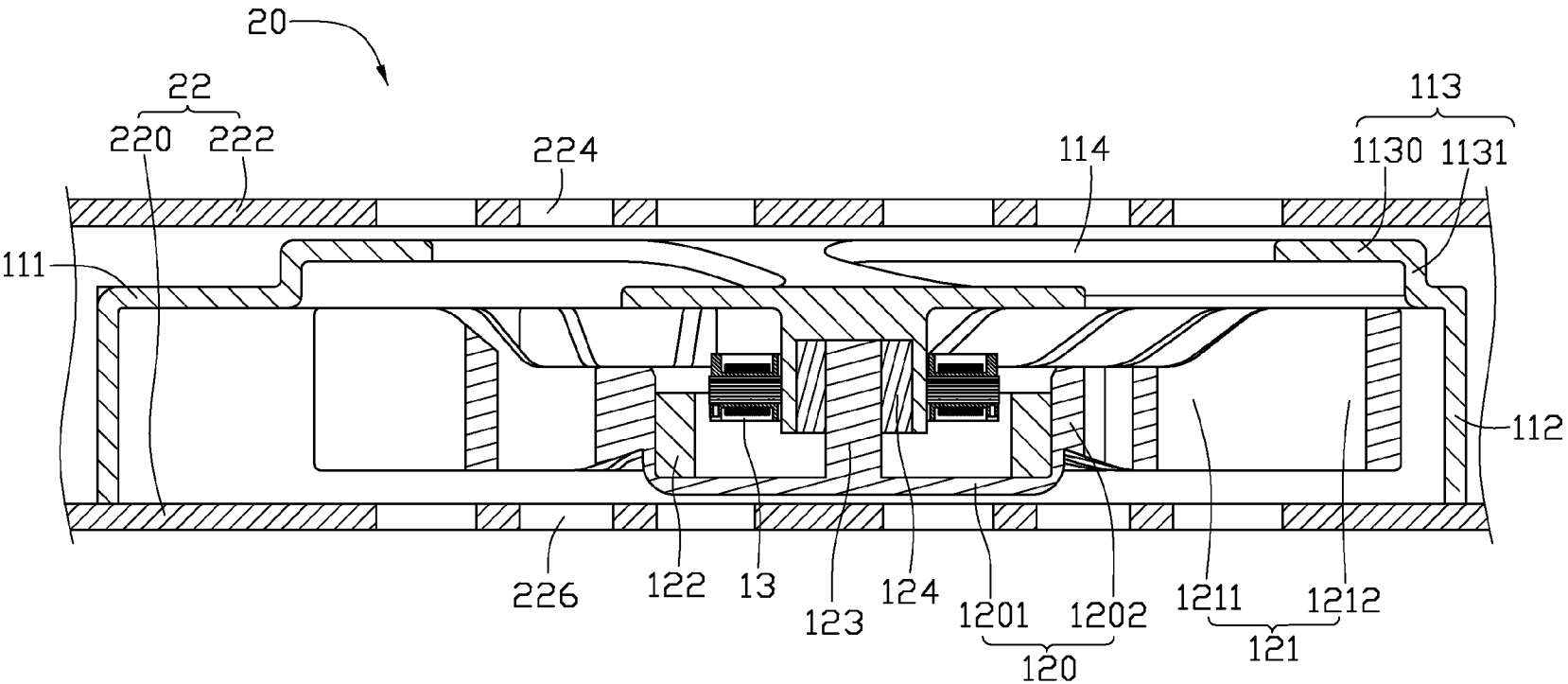
FIG. 5 is a cross-sectional view of the centrifugal fan of FIG. 1 assembled to the electronic device with the inverted state, in accordance with a second embodiment.

Referring to FIG. 5, a schematic view of the electronic device 20 incorporating with the centrifugal fan 10 in accordance with a second embodiment is illustrated, differing from the electronic device 20 described previously only in that the centrifugal fan 10 is mounted in the electronic device 20 inversely. The top end of the side plate 112 of the housing 11 contacts with a top surface of the base cover 220 of the shell 22. The bottom wall 1130 of the concave portion 113 faces the top cover 222, and spaces a distance from the top cover 222. The second through hole 226 of the bottom cover 220 functions as another air inlet of the centrifugal fan 10.

It is to be understood, however, that even though numerous characteristics and advantages of the disclosure have been set forth in the foregoing description, together with details of the structure and function of the invention, the disclosure is illustrative only, and changes may be made in details, especially in matters of shape, size, and arrangement of parts within the principles of the invention to the full extent indicated by the broad general meaning of the terms in which the appended claims are expressed.

What is claimed is:

1. A centrifugal fan comprising:

a housing comprising a base plate, a side plate extending upwardly from a periphery of the base plate and a concave portion depressed downwardly from a central portion of the base plate, the concave portion comprising a bottom wall spaced from the base plate and a side wall interconnecting with the base plate, an air inlet defined in the bottom wall; and an impeller comprising a hub and a plurality of blades extending radially from the hub, the impeller being rotatably arranged on the bottom wall of the concave portion, a bottom face of each of the blades extending into the concave portion.

2. The centrifugal fan of claim 1, wherein a base is formed in the bottom wall and received in the air inlet, the base comprises a supporting plate and a plurality of the ribs interconnected between an outer periphery of the supporting plate and an inner periphery of the bottom wall, the supporting plate and the base plate being coplanar, the ribs extending slantways between the supporting plate and the bottom wall, the impeller is mounted on the supporting plate.

3. The centrifugal fan of claim 2, wherein each of the blades comprises a first blade portion connected with the hub and a second blade portion extending smoothly from a distal end of the first blade portion, a longitudinal height of the first blade portion is increased along an extension direction of the first blade portion, the longitudinal height of the second blade portion is constant along the extension direction thereof.

4. The centrifugal fan of claim 3, wherein an inner diameter of each of the second blade portions is substantially the same as a diameter of the air inlet, and an outer diameter of each of the second blade portions is smaller than the diameter of the concave portion.

5. The centrifugal fan of claim 4, wherein a radial clearance formed between distal ends of each of the second blade portions and the side wall of the concave portion is about 0.05 mm.

6. The centrifugal fan of claim 1, wherein the bottom wall of the concave portion is parallel to the base plate, and the side wall extends perpendicularly from the base plate to connect with an outer periphery of the bottom wall.

7. The centrifugal fan of claim 1, wherein a base is formed in the bottom wall and received in the air inlet, the base comprises a supporting plate and a plurality of the ribs interconnected between an outer periphery of the supporting plate and an inner periphery of the bottom wall, the supporting plate and the bottom wall are coplanar to each other, the ribs extend horizontally between the supporting plate and the bottom wall, the impeller is mounted on the supporting plate.

8. An electronic device comprising:

a bottom cover;

a top cover opposite to the bottom cover;

a centrifugal fan received in between the two covers, the centrifugal fan comprising:

a housing comprising a base plate, a side plate extending upwardly from a periphery of the base plate and a concave portion depressed downwardly from a central portion of the base plate, the concave portion comprising a bottom wall spaced from the base plate and a side wall interconnecting with the base plate, an air inlet defined in the bottom wall;

an impeller comprising a hub and a plurality of blades extending radially from the hub, the impeller being rotatably arranged on bottom wall of the concave portion, a bottom face of each of the blades being lower than the base plate.

9. The electronic device of claim 8, wherein a top end of the side plate contacts with a bottom surface of the top cover, a through hole corresponding to the air inlet is defined in the top cover for functioning as another air inlet of the centrifugal fan.

10. The electronic device of claim 8, wherein a top end of the side plate contacts with a top surface of the bottom cover, a through hole corresponding to the air inlet is defined in the bottom cover for functioning as another air inlet of the centrifugal fan.

11. The electronic device of claim 8, wherein a base is formed in the bottom wall and received in the air inlet, the base comprises a supporting plate coplanar to the base plate and a plurality of ribs extending slantways between an outer periphery of the supporting plate and an inner periphery of the bottom wall, the impeller is mounted on the supporting plate; each of the blades comprises a first blade portion connected with the hub and a second blade portion extending smoothly from a distal end of the first blade portion, the longitudinal height of the first blade portion is increased along an extension direction of the first blade portion, the longitudinal height of the second blade portion is constant along the extension direction thereof, bottom faces of the second blade portions are lower than the base plate.

12. The electronic device of claim 8, wherein a base is formed in the bottom wall and received in the air inlet, the base comprises a supporting plate coplanar to the bottom wall and a plurality of ribs extending horizontally between an outer periphery of the supporting plate and an inner periphery of the bottom wall, bottom faces of the blades are lower than the base plate.

* * * * *